United States Patent [19]

Guy

[11] 4,180,246

[45] Dec. 25, 1979

[54] APPARATUS FOR STRETCHING CANVAS AND LIKE MATERIALS

[76] Inventor: Richard Guy, 27752 Torija, Mission Viejo, Calif. 92691

[21] Appl. No.: 956,076

[22] Filed: Oct. 30, 1978

[51] Int. Cl.[2] ..... B66F 19/00

[52] U.S. Cl. ..... 254/77

[58] Field of Search ..... 254/51, 77, 79, 83; 269/254 R, 37; 38/102 R, 102.91, 102.4; 160/378

[56] References Cited

U.S. PATENT DOCUMENTS

| | | | |
|---|---|---|---|
| 2,608,793 | 9/1952 | Gant | 254/77 |
| 2,832,171 | 4/1958 | Batey | 38/102.91 |
| 2,961,215 | 11/1960 | Schroeder | 254/79 |
| 3,414,994 | 12/1968 | Jaccard et al. | 38/102.91 |

*Primary Examiner*—Robert C. Watson

*Attorney, Agent, or Firm*—Francis X. LoJacono

[57] ABSTRACT

An apparatus for stretching canvas and like materials that must be stretch-mounted to a supporting stretcher-frame structure generally comprising a four-sided wooden frame member, whereby the canvas is stapled thereto. The apparatus comprises an elongated, horizontal, tubular, structural-beam member affixed at both ends to vertical supports; and has an elongated, biased, clamping bar member hingedly mounted along the full length of the upper surface of the structural-beam member, the clamping bar being provided with a canvas-securing keeper located thereon to engage, under tension, one edge of the canvas when the canvas is positioned between the clamping bar and the beam member. The operation of the clamping bar is provided by a spring-loaded handle and a trigger-release device, the trigger-release device being adapted to be adjustably positioned on either side of the canvas-stretcher frame during the operation thereof. Further included is a pair of stretcher-bar holders which are arranged to be slidably received on the beam member and to be adjustable to support various sizes of stretcher frames.

10 Claims, 8 Drawing Figures

FIG. 1
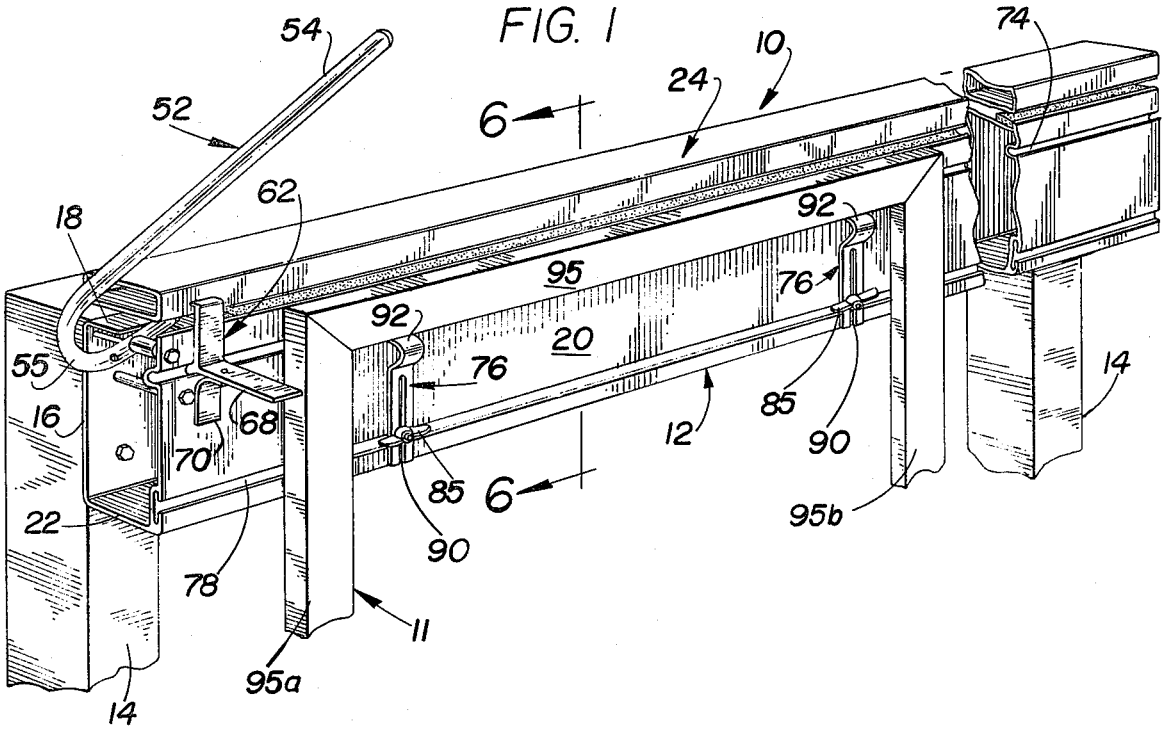
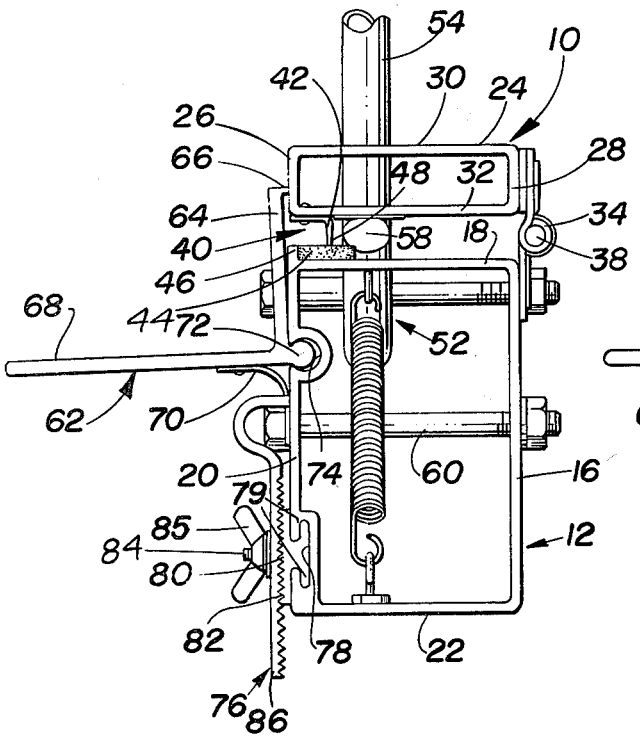
FIG. 2
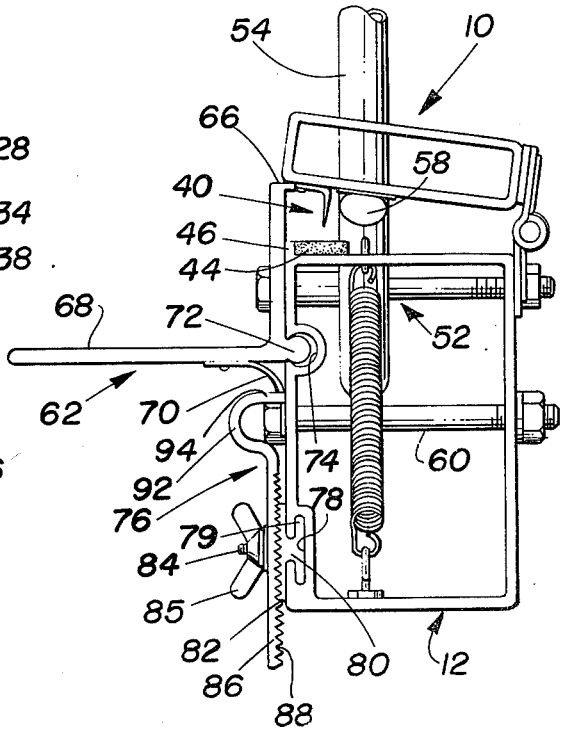
FIG. 3

APPARATUS FOR STRETCHING CANVAS AND LIKE MATERIALS

BACKGROUND OF THE INVENTION

1. Field of the Invention

This invention relates generally to a canvas-mounting device and, more particularly, to an apparatus that will provide canvas and like materials with a device to simultaneous stretch and mount the material to any size stretcher-frame structure.

2. Description of the Prior Art

As is well known in the art, various problems and difficulties are encountered in providing suitable means for simultaneously mounting and stretching canvas to a supporting stretcher frame structure, wherein the stretcher-frame structure comprises a generally rectangular framework having four wooden side members.

For years, the mounting and stretching of canvas—both in unpainted and painted form—have been generally accomplished by hand. Thus, many problems existed because the canvas was not stretched sufficiently or evenly along all four sides, creating waves or ripples in the stretched canvas. An artist was usually reluctant to use the framed canvas under such conditions.

Additionally, if a painted canvas was loose or had not been mounted and stretched properly, it could possibly not be sold for its true value.

Various types of mounting and stretching devices have been conceived and utilized, and some are still being used at the present time. However, these devices have features that restrict their use; and they are usually expensive, often complicated, and time-consuming in operation.

Canvas-stretching devices must be provided with means to grab and secure the canvas while it is being stretched and fastened to a frame structure. It has been found in the past that a regulated force must be provided to secure the canvas along its edge without ripping or damaging the canvas. Therefore, machines of this type have been produced with complicated pressure and hydraulic systems, which not only consume much space but are also very costly. Further, the designs of these devices are such that they are generally limited to a very small range of canvas frame sizes.

Accordingly, there is a need for a device of simple construction that is capable of accepting all sizes of frame structures, without damage to the canvas as it is stretched and fixed to the frame member.

SUMMARY OF THE INVENTION

The present invention comprises an apparatus for stretching and mounting canvas and other like materials to a stretcher-frame structure. The apparatus itself comprises an elongated, tubular, structural-beam member that is horizontally disposed and affixed at each end to vertical supports. A spring-loaded, clamping-bar member is hingedly connected to the structural beam so as to be positioned along the top wall of the beam, thus defining a jaw-like member having a longitudinal-securing keeper bar mounted to the underside of the clamping bar. This allows one free edge of the canvas to be releasably secured while tension is being placed on the canvas as it is stretched over the canvas-stretcher frame.

It should be noted that this apparatus is also adapted to stretch needlepoint materials as well as silk-screen materials.

Mounted to one end of the main beam is an operating handle that is spring-loaded whereby the spring-loaded clamping bar can be placed in an open position to receive the free edge of the canvas material. As the clamping bar is opened, it is engaged by an automatic, releasable, locking trigger that prevents the clamping bar from closing until the canvas is ready to be stretched. That is, the locking trigger is pivotally mounted to the main beam and adapted to be longitudinally adjusted thereon. By pressing downwardly on the trigger, the clamping bar along with the keeper bar engage the free end of the canvas and allow the frame to be rotated downwardly over a pair of stretcher-bar holders. The stretcher-bar holder is also slidable along the full length of the main beam member, so as to be adjustable to any particular size of canvas-stretcher frame.

Accordingly, each free edge of the canvas is positioned by the jaw-like operation and then stretched, at which time the secured edge is stapled along the length of the mounting-frame member.

OBJECTS AND ADVANTAGES OF THE INVENTION

The present invention has for an important object a provision wherein the apparatus includes a longitudinal, releasable, locking trigger and a pair of longitudinally adjustable stretcher bar holders, whereby various sizes of canvases can be mounted to corresponding sizes of frame members.

It is another object of the invention to provide an apparatus to stretch and mount canvas or like materials, wherein the apparatus is spring-actuated rather than hydraulically-actuated, whereby the force provided by the spring members is sufficient to firmly secure the canvas within the clamping-jaw arrangement while applying the necessary tension thereto.

Still another object of the invention is to provide a device of this character that is relatively inexpensive to manufacture, and that is simple and rugged in construction.

It is still another object of the invention to provide a canvas-stretching apparatus that includes relatively few operating parts.

Still a further object of the invention is to provide an apparatus of this character that is easily serviced and maintained.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial view of the present invention supported by vertical end members and wherein a portion of a stretcher-frame member is shown supported by a pair of stretcher bar holders;

FIG. 2 is an end view of the apparatus shown in a closed mode;

FIG. 3 is an end view similar to FIG. 2 wherein the upper clamping bar is shown in an open mode;

DESCRIPTION OF THE PREFERRED EMBODIMENT

Figure 4:
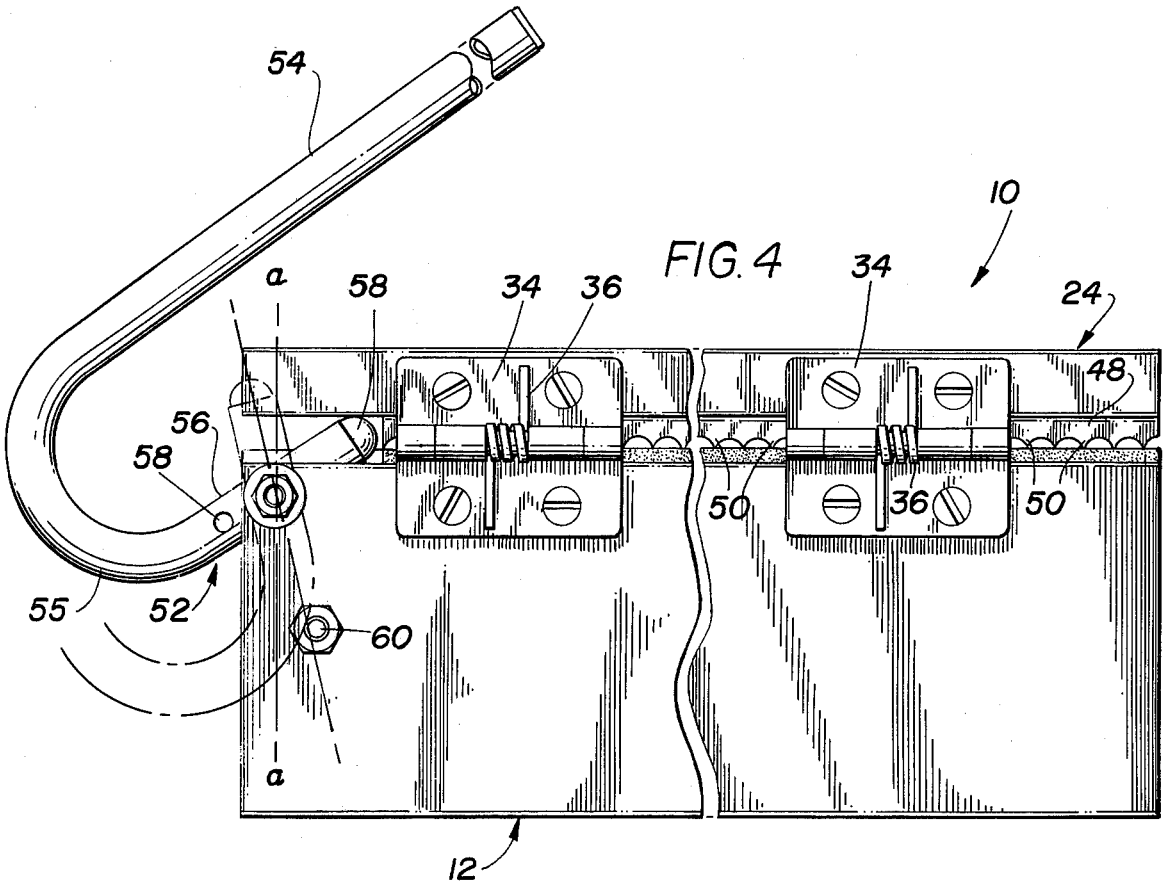
FIG. 4 is a rear-elevational view with the central portion broken out to illustrate both ends thereof, including biased hinge members.

Referring more particularly to FIG. 1, there is shown a canvas-stretching-and-mounting apparatus, generally indicated at 10, having supported thereon a stretch-frame member 11, the apparatus comprising a main, structural, elongated beam member 12. Beam 12 is horizontally mounted at each free end to vertical support members 14. It should be noted that support members 14 represent various types of stands or support structures that would allow apparatus 10 to be mounted horizontally, as herein shown and described.

Beam 12 is further formed as a substantially rectangular tubular member by means of extrusion molding wherein the beam is defined by a rear wall 16 attached directly to the support members 14, a top wall 18, a front wall 20, and a bottom wall 22. Hingedly mounted to the rear wall 16 and longitudinally disposed over the top wall 18 is a clamping bar 24, which is also a hollow tubular member defined by a front wall 26, rear wall 28, and top and bottom walls 30 and 32, respectively.

Thus a hinge means 34 is provided, and is mounted to the rear walls 16 and 28 of beam 16 and clamping bar 24, respectively, whereby clamping bar 24 is spaced upwardly from beam 12. This can be seen in FIGS. 3 and 4; and further in FIG. 4 where at least two hinges are shown employed and appropriately spaced apart evenly so as to carry the loads placed on the clamping bar during the operation thereof.

Included within each hinge 34 is a biasing means 36, illustrated as a coil spring located about the hinge pin 38. (See FIGS. 4 and 5.) Spring 36 creates a downward biasing force on clamping bar 24, thereby providing the necessary engaging force between the clamping bar and the top wall 18 of beam 12, whereby a free edge of a canvas or like material can be readily secured during the stretching and mounting steps. A detailed description of this procedure will hereinafter be described.

To further provide a more positive securing of the edge of a canvas, there is included a keeper means, generally indicated at 40, and shown in FIGS. 2, 3, 6, 7 and 8. Keeper means 40 comprises mainly an elongated securing keeper bar 42 which is mounted along the full length of the bottom leading edge of clamping bar 24; and it includes a band or strip 44 of pliable material attached to the adjacent leading edge of beam 12, wherein the leading edge thereof is defined by a vertical flange 46. Thus, keeper bar 42 directly engages strip 44—providing a jaw-like arrangement.

It should be noted at this time that keeper bar 42 can be arranged in any suitable configuration that will mount canvas or other materials, such as those used in needlepoint and silk-screening. The arrangement and form of keeper bar 42 as shown is designed for canvas material. That is, keeper bar 42 is shown having a substantially "L"-shaped cross-sectional configuration wherein the depending member 48 is provided with a plurality of arcuate teeth members 50 formed along the full length of member 48. This arrangement can be seen in FIG. 4.

Accordingly, during the series of steps in the operation of the apparatus, the jaw-like arrangement of clamping bar 24 must be continuously opened and closed. Thus, to provide this action, a lever-actuating means, indicated generally at 52, is mounted to the apparatus, whereby clamping bar 24 can be opened along the leading edge so as to allow the free edge of the material to be inserted between keeper bar 42 and strip 44, and then closed to secure the material therein. As herein illustrated, lever-actuating means 52 comprises a handle 54 having a gripping, extended free end and a pivoted curved end 55, including an extended neck portion 56 which is tipped with a nylon head member 58.

In this embodiment, actuator means 52 is shown positioned adjacent the left end of the apparatus; however, either end can be used but the left end mounting is preferred for better overall operation of the machine.

Figure 5:
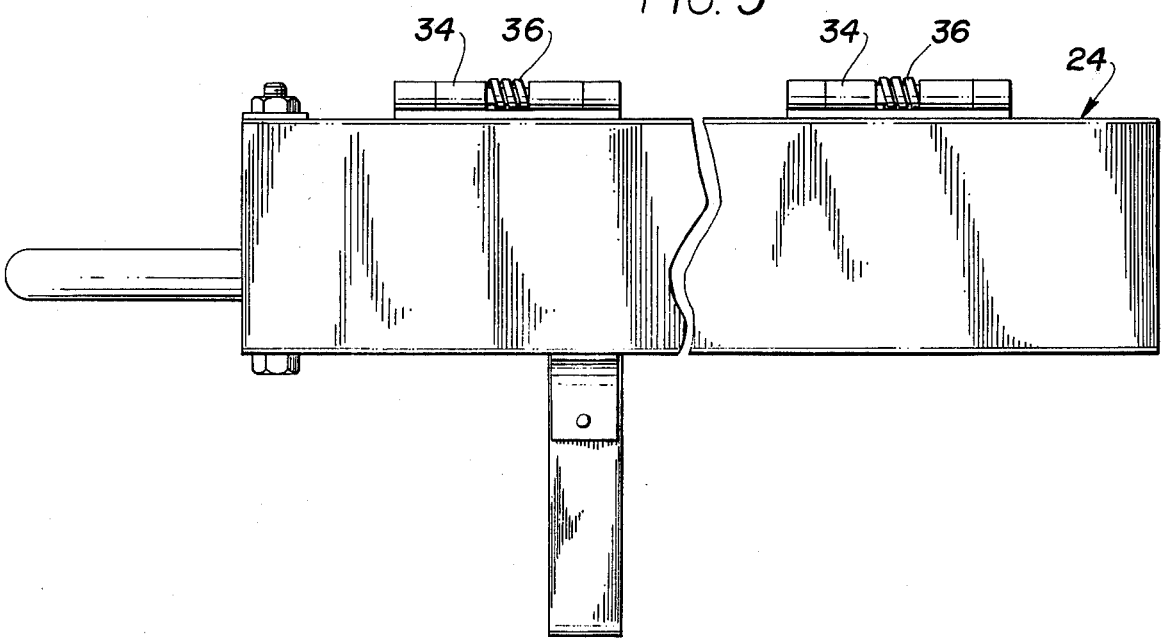
FIG. 5 is a top plan view thereof.
Figure 7:
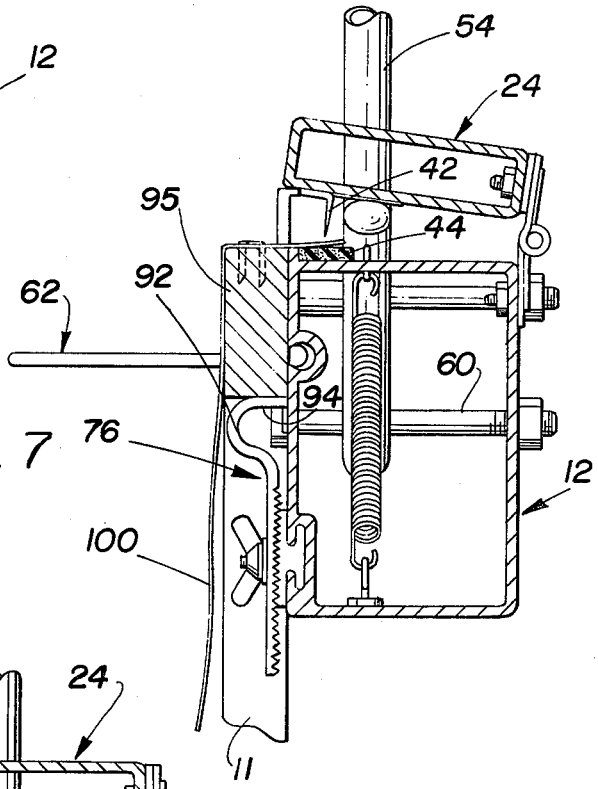
FIG. 7 is a cross-sectional view similar to FIG. 6, wherein the canvas is released from the securing keeper after being stapled to the canvas-frame member.

In FIGS. 1 and 4, handle 54 is shown in a closed mode whereby biasing means or spring 56, which is attached between handle 54 and beam 12, secures handle 54 in a downwardly released position. It should be noted that neck portion 56 is provided with a plurality of holes 58 through which is located a mounting bolt, providing a pivot point about which handle 54 rotates. Thus, to open clamping bar 24, handle 54 is pulled outwardly, causing head 58 to forceably engage bottom wall 32 of bar 24 and thereby lifting clamping bar 24, as seen in FIGS. 3 and 7. As the handle is rotated, neck 56 abuts a stop means defined by pin 60. At this position, handle 54 is held in an open mode and is retained in that position as head 58 passes the vertical center line a-a, as seen in FIG. 4. Accordingly, handle 54 can be manually returned to a closed mode, allowing clamping bar 24 to again close.

However, for a more complete and safer operation of the clamping action, there is further provided a releasable locking means, indicated generally at 62.

The releasable locking means is arranged to be pivotally attached to beam 12 so as to automatically engage bar 24 as bar 24 is raised to an open position by handle 54. Locking means 62 is also adjustable along the full length of the apparatus; and it comprises a substantially "L"-shaped lever arm wherein the upright member 64 is provided with a protruding latch tongue 66 which engages the leading edge of clamping bar 24 in an open locked mode. The latch member 68 of the lever arm extends outwardly from the apparatus so as to be pressed for releasing of bar 24. That is, the lever arm 62 is provided with a flat spring member 70 that establishes a biasing force to cause the arm to pivot inwardly, thereby automatically engaging clamping bar 24 in a locked open mode when raised, as seen in FIGS. 3 and 7. The locking lever arm 62 includes an annular rib member 72 which is slidably received in a circular longitudinal groove 74 formed along the full length of beam 12, as seen in FIG. 1. Depending upon the operator and the size of frame 11, lever arm 62 can be positioned at a convenient location along the apparatus, either to the left or to the right of the frame 11.

Figure 6:
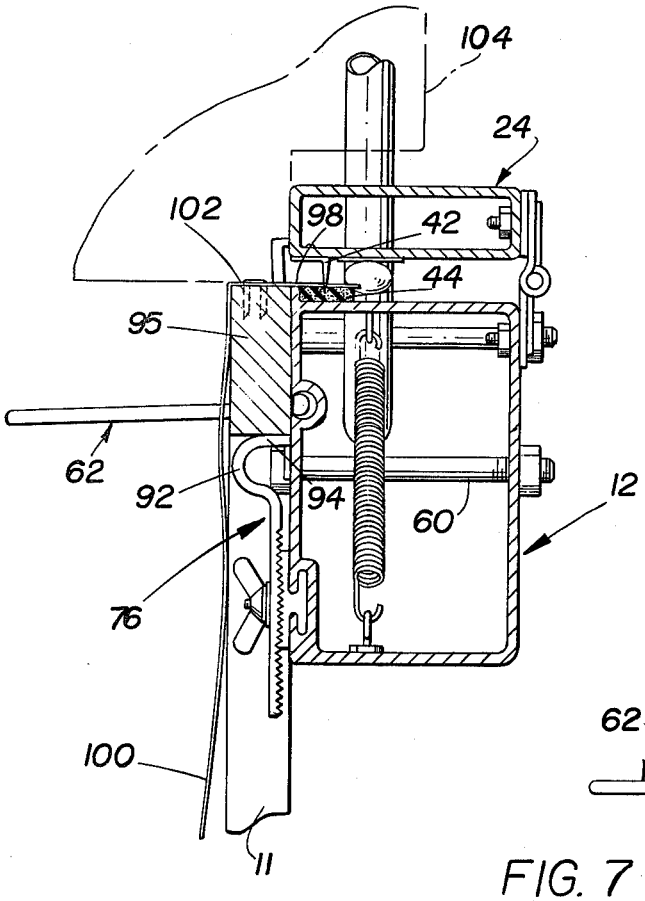
FIG. 6 is a cross-sectional view taken substantially along line 6—6 of FIG. 1, wherein the canvas is shown being stapled to the stretcher frame for the initial mounting step.

Due to the fact that it is very important to position frame 11 on a level and equal plane relative to the upper leading edge 46 of beam 12 (See FIGS. 6 and 7.), there is included a frame-positioning means represented by a pair of frame holders 76. The frame holders are designed to be adjusted vertically and horizontally along beam 12. Beam 12 is provided with a longitudinal channel 78 having inwardly formed flanges 79 disposed along the lower face of front wall 20, wherein there is slidably received a mounting-lug member 80 formed to fit the configuration of channel 78. Lug 80 includes a keyed face 82 defined by a plurality of teeth members and a threaded pin 84, to which a wing nut 85 is mounted. Coupled to lug 80 is the frame-support holder 76, the holder being adjustable vertically by means of a keyed inner face, represented by matching teeth 88, so as to engage with teeth 82 of lug 80. The frame-support holder further comprises an extended flat body 86 having an elongated slot 90 disposed therein to adjustably receive pin 84. Slot 90 allows holder 76 to be raised or lowered to the proper height for each particular size frame structure. The upper end of holder 76 includes a support head 92 formed having a substantially "C"-shaped configuration, wherein the curved head portion protrudes outwardly from beam 12 and then projects inwardly, providing a substantially flat shoulder member 94 on which one of the frame bars 95 is supported, such as seen in FIGS. 1, 6 and 7.

OPERATION

The following is one example of how the canvas is stretched and mounted to the canvas-frame structure 11.

After the main structure of apparatus 10 is fixedly mounted to a support structure, as indicated by 14, the frame holders 76 are positioned and set to accept a particular canvas frame 11. Thus, each holder 76 is located and positioned longitudinally within channel 78, whereby each holder is adjacent the respective upright frame bars **94*a* and 95*b*, as seen in FIG. 1. Once the longitudinal position of holders 76 is set, the vertical position is set by raising or lowering the holder up or down until the stapled edge of frame bar 95 is even with the top of beam 12 (as seen in FIGS. 6 and 7) and tightening nuts 85**.

Handle 54 is pulled to open the clamping bar, at which time the releasable locking trigger 62 latches under clamping bar 24, holding it open. Then, a free edge 98 of a canvas 100 is positioned between keeper bar 42 and strip pad 44. The canvas is pressed against the corners of frame bar 95 to determine the alignment of the canvas to the frame. When the canvas is in the proper location, trigger 62 is pressed, allowing clamping bar to close. The operator slides an index finger along the length of the leading edge of bar 95, thereby creasing the canvas at point 102 (FIG. 6). The canvas is now stapled to bar 95, this being done generally with an electric stapler 104.

Handle 54 is again pulled to open clamping bar 24 (See FIG. 7.), thus releasing the edge of canvas 100—clamping bar again being latched by trigger 62.

Figure 8:
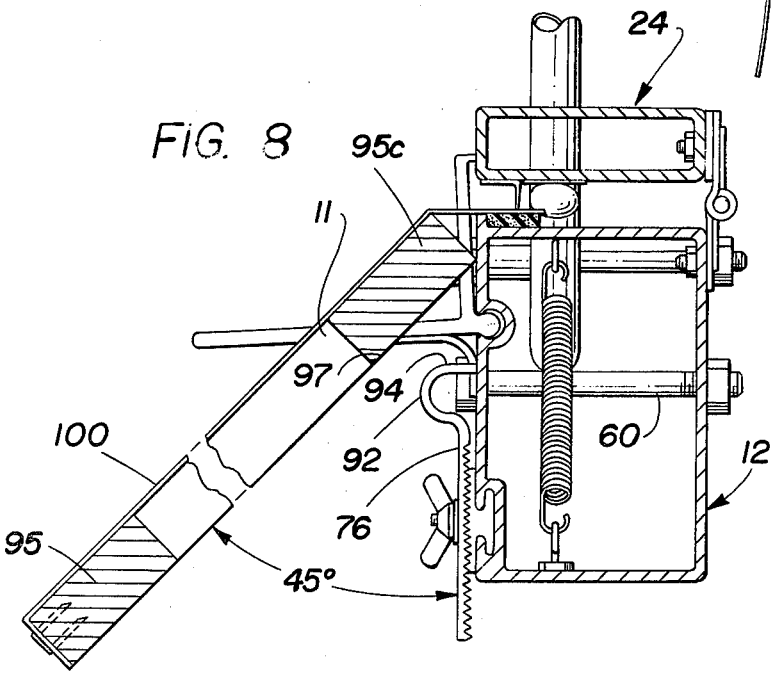
FIG. 8 is also a cross-sectional view similar to FIG. 6, with the frame being positioned to stretch the canvas across the frame.

The canvas together with the stretcher frame 11 is turned around to the opposite side (the unstapled side) and the free edge of the canvas is again positioned under keeper 42. The canvas frame 11 is held against beam 12 above holders 76 at approximately 45 degrees, as indicated in FIG. 8. It should be noted that the higher the frame 11 is held the tighter the canvas is stretched. A 45-degree angle, however, is the preferred angle in most mounting operations.

The trigger is again released and the frame is rotated downwardly, causing bar **94*c* to engage along edge 97 with the arcuate cam surface of head 92 of holder 76 until bar 95*c* is flush against beam 12. The canvas is now stretched in one direction and is stapled in place. Canvas 100 is again released, and then the corners are folded on the unstapled side, the unstapled side being again positioned in the machine, as described before, at an approximate angle of 45 degrees and clamped therein. The canvas is stretched against the holders 76 and stapled to the frame bar 95. The remaining free edge of the canvas is stretched and stapled as described, at which time the canvas should be secured to all sides of the canvas-frame structure 11** in a very smooth and tight manner.

The unique arrangement of the elements of the present device allows the use of virtually any stapling device presently available. Thus, manual, electrical or air-gun types are compatible with the present invention.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form or uses mentioned, except as defined in the accompanying claims.

I claim:

1. An apparatus for stretching and mounting canvas and like materials to a frame structure, wherein the apparatus comprises:

an elongated structural-beam member adapted to be horizontally mounted to a support structure;

a clamping-bar member hingedly connected to said beam member throughout the length thereof;

keeper means disposed between said clamping bar and said beam member to releasably secure a free edge of said canvas therein;

a lever-actuating means positioned adjacent one end of said apparatus to control the opening and closing of said clamping bar;

spring-biasing means disposed between said clamping bar and said beam member, whereby a biasing force is equally applied throughout the length of said clamping bar;

hinge means interconnecting said clamping bar and said beam member whereby said clamping bar is movable relative to said beam member; and frame-positioning means adjustably mounted to said beam member wherein said frame structure is positioned and supported on said apparatus so as to allow said canvas to be secured thereto in a tightly stretched manner.

2. An apparatus as recited in claim 1, wherein said apparatus includes a releasable locking means disposed between said clamping bar and said beam member whereby said clamping bar is held in an open position.

3. An apparatus as recited in claim 2, wherein said lever actuating means comprises:

a handle pivotally attached to said beam member at one end thereof and having an engaging head member to operably engage said clamping bar;

means to limit the movement of said handle when said clamping bar is moved to an open position; and spring means attached to said handle to return it to an inoperative position.

4. An apparatus as recited in claim 3, wherein said releasable locking means comprises:

a lever-arm member pivotally mounted to said beam member for locking engagement with said clamping bar, thereby holding said clamping bar in a locked-open position;

means for pivotally attaching and sliding said lever arm longitudinally along said beam member; and biasing means disposed between said lever and said beam member to cause said lever arm to pivot to a locked position when said clamping bar is opened by said handle.

5. An apparatus as recited in claim 4, wherein means for pivotally attaching and sliding said lever arm comprises:

an annular rib member formed on said lever arm; and an annular groove formed longitudinally along the front wall of said beam member to slidably and pivotally receive said rib member.

6. An apparatus as recited in claim 4, wherein said keeper means comprises:

a keeper bar mounted to the underside of said clamping bar and adjacent the longitudinal free edge of said clamping bar; and a resilient pad formed as a longitudinal strip affixed to the upper portion of said beam member, and disposed so as to be engaged by said keeper bar when said clamping bar is in a closed position.

7. An apparatus as recited in claim 6, wherein said keeper bar includes a plurality of depending teeth formed along the length thereof.

8. An apparatus as recited in claim 5, wherein said frame positioning means comprises:

a pair of frame holders adjustably spaced apart to support said frame structure;

a lug member slidably mounted to said front wall of said beam member along the longitudinal length thereof, and adapted to couple with said frame holder for vertical adjustment thereof; and a longitudinal channel formed in said front wall of said beam member to slidably receive said lug members therein, whereby said frame holders are adjustable horizontally thereon.

9. An apparatus as recited in claim 8, wherein said frame holder comprises:

an extended flat body wherein the backside thereof is provided with a keyed surface;

an elongated slot formed in said flat body; and a cam head disposed at the upper end of said flat body for engagement with said frame structure.

10. An apparatus as recited in claim 9, wherein said lug member is provided with a keyed surface for coupling engagement with said keyed surface of said frame holders.

* * * * *